US009097481B2

(12) United States Patent
Chaney

(10) Patent No.: US 9,097,481 B2
(45) Date of Patent: Aug. 4, 2015

(54) GUN SUPPORT FOR A TRIPOD

(71) Applicant: Walter L. Chaney, Glendale, AZ (US)

(72) Inventor: Walter L. Chaney, Glendale, AZ (US)

( * ) Notice: Subject to any disclaimer, the term of this patent is extended or adjusted under 35 U.S.C. 154(b) by 0 days.

(21) Appl. No.: 14/056,621

(22) Filed: Oct. 17, 2013

(65) Prior Publication Data

US 2015/0107146 A1 Apr. 23, 2015

(51) Int. Cl.
*F41A 23/14* (2006.01)

(52) U.S. Cl.
CPC ..... *F41A 23/14* (2013.01)

(58) Field of Classification Search
CPC ..... F41A 23/10; F41A 23/16; F41A 23/08; F41A 23/06; F41A 23/04; F41A 23/14; F41A 23/12
USPC ..... 248/166, 49, 62; 42/94; 89/37.01, 89/37.03, 37.04, 37.09, 37.12, 37.14, 89/40.01, 40.06, 41.16, 41.17, 41.18
See application file for complete search history.

(56) References Cited

U.S. PATENT DOCUMENTS

| | | | | | |
|---|---|---|---|---|---|
| 2,847,909 | A * | 8/1958 | Kester | 89/40.06 |
| 2,870,683 | A * | 1/1959 | Wilson | 89/40.06 |
| 3,863,376 | A * | 2/1975 | Dalmaso | 42/94 |
| 4,967,497 | A * | 11/1990 | Yakscoe | 42/94 |
| 5,930,933 | A * | 8/1999 | Schleicher | 42/94 |
| 6,086,027 | A * | 7/2000 | Klimbacher | 248/166 |
| 6,192,613 | B1 * | 2/2001 | Lantz | 42/94 |
| 7,066,438 | B2 * | 6/2006 | Ma | 248/448 |
| 8,549,786 | B1 * | 10/2013 | Griffith | 42/94 |

* cited by examiner

*Primary Examiner* — Samir Abdosh
*Assistant Examiner* — John D Cooper
(74) *Attorney, Agent, or Firm* — The von Hellens Law Firm, Ltd.

(57) ABSTRACT

A gun support includes a bracket pivotally supporting two stanchions detachably attachable to respective legs of a tripod. The gun support is foldable adjacent the tripod upon collapse of the tripod and extendable from the tripod upon pivotal extension of the legs of the tripod.

17 Claims, 2 Drawing Sheets

GUN SUPPORT FOR A TRIPOD

BACKGROUND OF THE INVENTION

1. Field of the Invention

The present invention relates to gun rests and, more particularly, to tripod mounted gun rests.

2. Description of Related Prior Art

For long-range shooting on the order of several hundred yards, a shooter generally uses a rest of some type to maintain the rifle steady. Such a rest may be a sandbag or the like for shooting from a prone position. When shooting from a sitting, kneeling, or standing position, a raised rest of some type is usually used. If available, a tree or other above-ground platform-like element may be used.

To provide versatility for using a gun rest of selectable height and upon terrain that may not be smooth and flat, a tripod may be used. The tripod permits independent extension of the three legs to accommodate the supporting surface. A fixture may be attached to the top of the tripod to support the rifle. This arrangement provides a single external support for the rifle. To enhance stabilization with the rifle, an upright, pivotally attached to one of the legs of the tripod, may be used. It includes at the upper end a platform of some type to assist in supporting the rifle. One of the main problems attendant such an upright is that it is not necessarily steady for and aft or sideways. Thus, even though two points of support are provided, the lack of stability of the upright may compromise the accuracy of the shot being taken.

SUMMARY OF THE INVENTION

Tripods having a U-shaped element for receiving a rifle have been used to steady a rifle for a target several hundred yards away. Tripods have the benefit of being height adjustable and can accommodate uneven or sloping terrain by appropriately adjusting the length of each of the three legs. The present invention is directed to a gun support that enhances the use of a tripod for stabilizing a rifle by having attached to two of the tripod legs a bracket to provide a second point of support for the rifle. By using two stanchions extending from the bracket in mechanical engagement with corresponding legs of the tripod, the resulting triangle precludes lateral displacement of the bracket and aids in stabilizing the rifle prior to and during the shot. The lower end of each stanchion is attached to a clamp of the respective leg of the tripod. For transport and storage purposes, the tripod is collapsed in the conventional manner. Such collapse brings each stanchion adjacent the respective leg of the tripod as a result of the pivotal attachment between each stanchion and its respective clamp and the pivotal attachment of each stanchion with the bracket. Thereby, the gun support can be readily transported in search of game and is rapidly erectable when game or a target is spotted.

It is therefore a primary object of the present invention to provide a stable gun support for a rifle.

Another object of the present invention is to provide a tripod for supporting one location on a rifle and a gun support for supporting a second location on a rifle.

Still another object of the present in invention is to provide a gun support for a rifle attached to two legs of a conventional tripod.

Yet another object of the present invention is to provide a gun support attached to two legs of a tripod that is collapsible upon collapse of the tripod itself.

A further object of the present invention is to provide a gun support useable in conjunction with any tripod to provide support for a rifle, other gun or a device.

A still further object of the present invention is to provide a gun support pivotally attached to two legs of a tripod.

A yet further object of the present invention is to provide a gun support for a rifle that is attached to each foot of two legs of a tripod.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
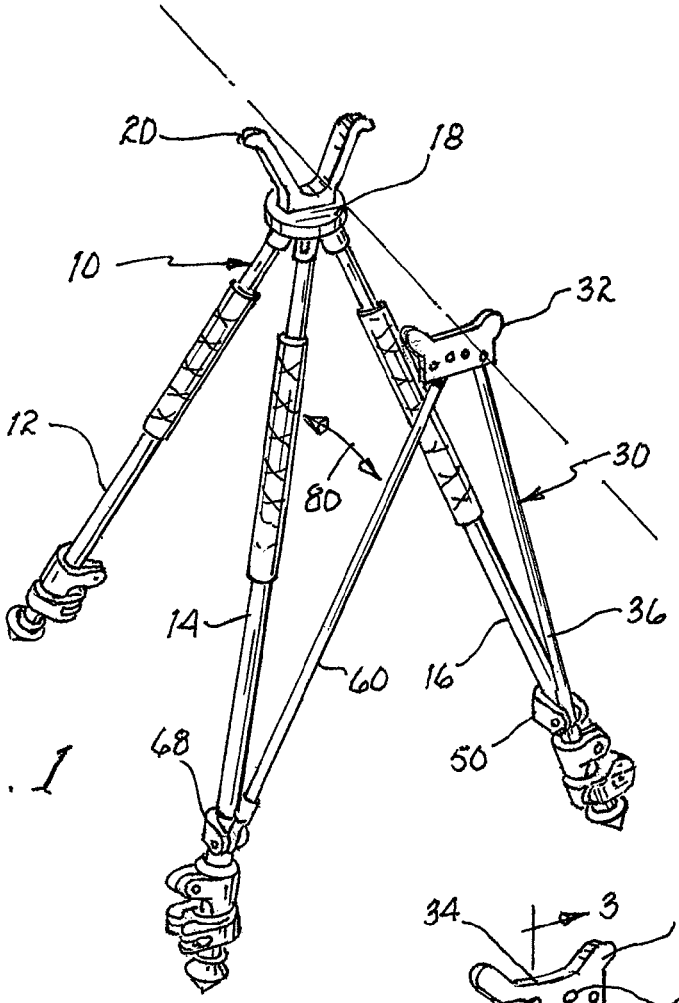
FIG. 1 is an isometric view of a gun support attached to a conventional tripod.

Referring to FIG. 1, there is shown a conventional tripod 10 having three extendible legs 12, 14 and 16. These legs are pivotally attached to a plate 18, or the like. A receiver 20 in the form of a U-shape is attached to plate 18. The function and purpose of receiver 20 is to serve as a rest for a location on a rifle in preparation for shooting at a target that may be several hundred yards distant. The tripod depicted is a representation of a tripod sold by Bog Gear, LLC, Fredericksburg, Tex.

Tripod 10 may be regularly used in the field as each of legs 12, 14 and 16 may be adjusted to conform with the surface of the terrain to position receiver 20 in essentially a vertical orientation, as depicted in FIG. 1. To hit a target several hundred yards away requires a great deal of skill. It also requires experience to take into account any wind acting on the projectile and whether the target is higher or lower than the rifle. Moreover, the rifle must be essentially still at the time the projectile is fired. While a tripod configured as illustrated in FIG. 1 and described above is of significant benefit to hit a distant target, there is a potential likelihood of movement of the rifle at the time the projectile is fired due to breathing or other incremental motion of the shooter.

Figure 3:
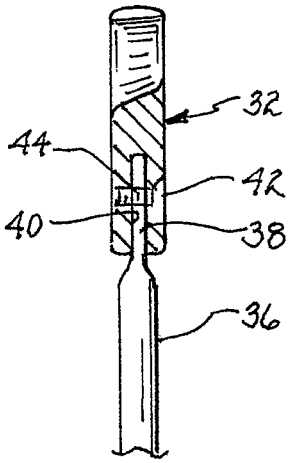
FIG. 3 is a partial cross-sectional view taken along lines 3-3, as shown in FIG. 2.

To provide additional stability of the rifle, a gun support 30 is used. Referring jointly to FIGS. 1, 2, 3 and 4, the features and operation of the gun support will be described in detail. The gun support includes a bracket 32 for providing a second point of support for the rifle. It may be configured as, and functionally equivalent to, receiver 20 mounted on tripod 10. That is, it may have in the manner of a V-shaped or U-shaped surface for supporting the rifle. A first stanchion 36 pivotally depends from bracket 32. It may include a flattened end 38 extending into a slot 40 in bracket 32, as shown in FIG. 3. A screw 42 or the like, extends into bracket 32 to pivotally engage a hole 44 in flattened end 38. The size of slot 40 must be of sufficient dimension to accommodate pivotal movement of stanchion 36 therein. Lower end 46 of stanchion 36 is flattened and apertured. A clamp 50 includes wings 52, 54 disposed on either side of flattened end 46. A screw 56 extends through an aperture in wing 52, the aperture in flattened end 46 and into threaded engagement with an aperture in wing 54. Thereby, the clamp can be tightened. Stanchion 60 is essentially duplicative in configuration of stanchion 36 and includes a flattened end 62 in pivotal engagement with screw 64 in bracket 32. Similarly, flattened end 66 is in engagement with clamp 68 and disposed intermediate wings 70, 72 and retained therein by screw 74.

Figure 2:
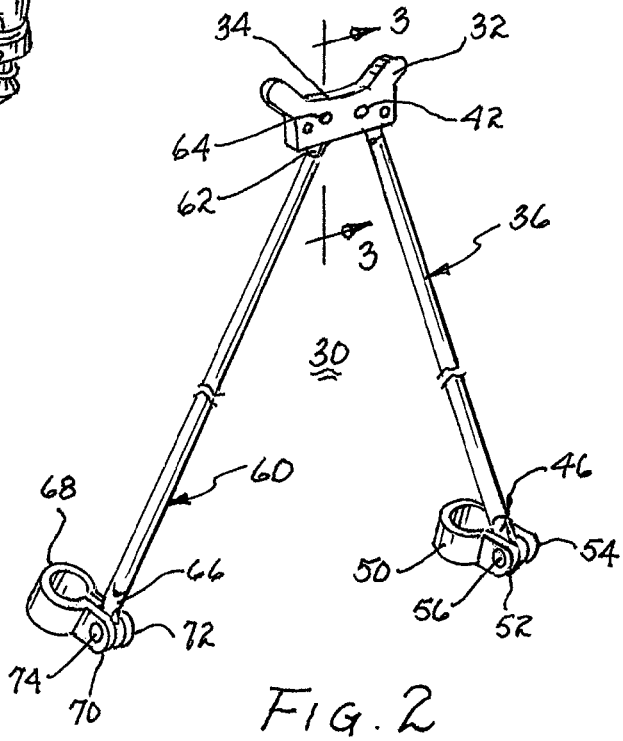
FIG. 2 is a view of the gun support that may be attached to a conventional tripod.
Figure 4:
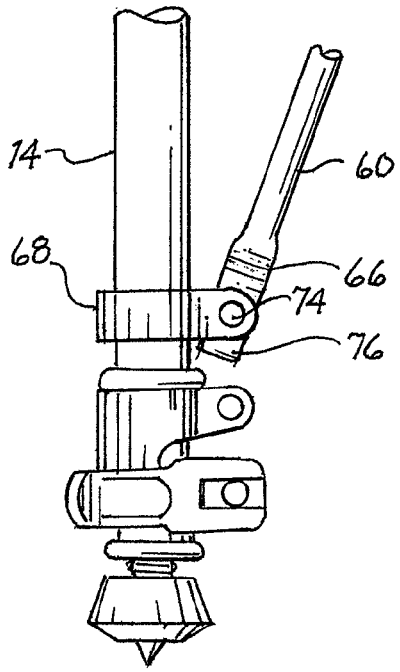
FIG. 4 illustrates the pivotal attachment of the gun support to the lower end of a leg of a tripod.

Referring jointly to FIGS. 1, 2, and 4, attachment of gun support 30 with tripod 10 will be described in further detail. Clamp 68, supporting stanchion 60, encircles leg 14 of the tripod and is frictionally held in place by tightening screw 74. The angle between gun support 30 and tripod 10, as depicted by arrow 80 in FIG. 1, can be set by clamping flattened ends 46, 66 of stanchions 36, 60 to prevent pivotal movement between the stanchions and the respective clamps. Alternatively, flattened end 66 of stanchion 60 may include an extension 76 to bear against leg 14 as the angle represented by arrow 80 is increased. The resulting engagement of flattened end extension 76 with leg 14 will prevent further angular displacement of stanchion 60 (and stanchion 36) and hence the gun support from the tripod. It is to be understood that screws 56 and 74 may be replaced by bolts with wingnuts to permit ease of adjustment in the field and/or during use. By using wingnuts, the angular position (arrow 80) of gun support 30 can be fixed relatively quickly to provide the desired position of bracket 32 relative to the tripod.

Figure 5:
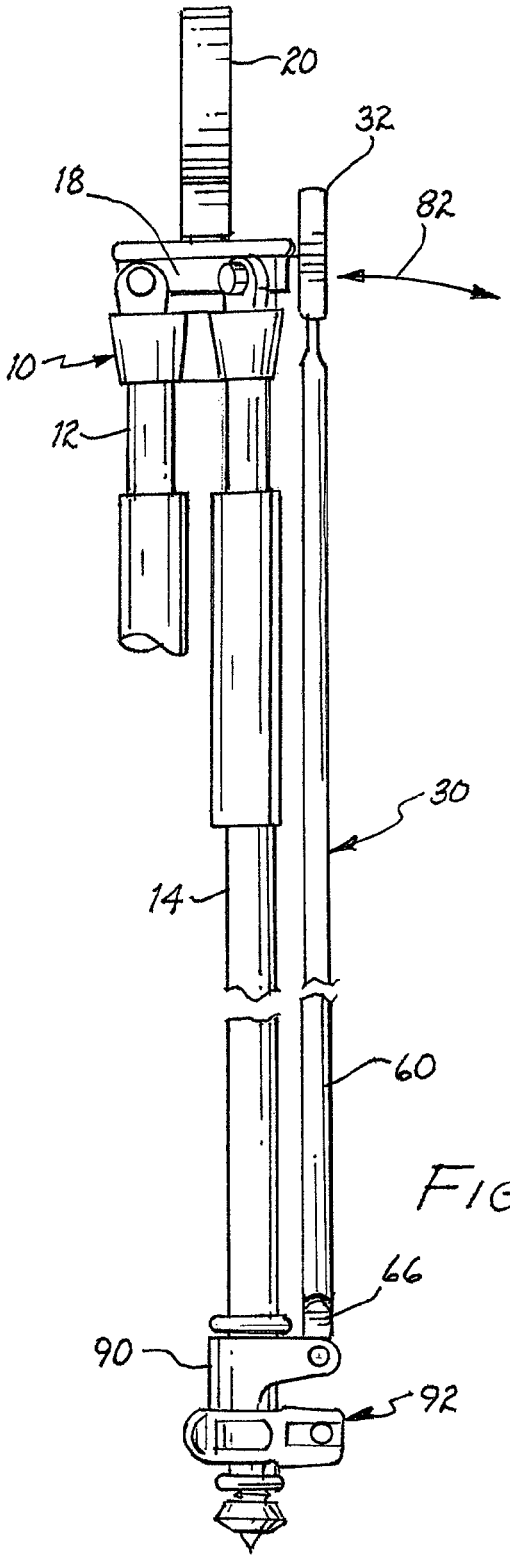
FIG. 5 illustrates a leg of the gun support pivotally attached to a clamp formed as part of the foot of a leg of a tripod.

Several distinct features are illustrated in FIG. 5. First, tripod 10 may be collapsed in the conventional manner by bringing the three legs 12, 14 and 16 toward one another, as illustrated. During such collapse, gun support 30 is angularly repositioned adjacent the collapsed tripod, as represented by arrow 82. Because of the pivotal movement of stanchions 36, 60 possible by use of screws 42, 64 or the like to permit pivotal movement of the stanchions relative to bracket 32, the stanchions can be collapsed toward one another in the same angular displacement as effected with respect to legs 12, 14 and 16. Thereby, the tripod, in combination with the gun support, can be collapsed to a relatively compact state for transport and storage.

Second, some tripods incorporate a clamp 90, as depicted in FIGS. 1 and 5, at the foot of each leg. This clamp may be used to receive and clamp flattened end 66 of stanchion 60. It is to be understood that clamp 90 is part of foot 92 present at the lower end of each of legs 12, 14 and 16. When such a clamp is part of foot 92, clamps 50 and 68, shown in FIGS. 1, 2 and 4, may be eliminated.

It is to be understood that in the expanded position of gun support 30, represented by arrow 80 in FIG. 1, may be set in a number of ways. As described with respect to FIG. 4, the flattened ends of each of the stanchions may be extended to interfere with the respective leg of the tripod once a certain desired angle 80 is reached. Alternatively, a chain interconnecting the gun support and the tripod may be used to limit angle 80. As alluded to above, the clamp supporting each stanchion may be tightened manually or with a tool to set the desired angle 80 of the gun support. Other arrangements may also be incorporated.

I claim:

1. A support for use with a tripod having a U-shaped receiver at the top of the tripod to support a gun, said support comprising:

(a) a one-piece bracket including a centrally located recessed solid surface for supporting a location on the gun;

(b) one end of a first stanchion pivotally supported from said bracket;

(c) one end of a second stanchion pivotally supported from said bracket;

(d) a first clamp disposed on an other end of said first stanchion adapted for slidably engaging and clamping said other end of said first stanchion to a leg of the tripod; and (e) a second clamp disposed on an other end of said second stanchion adapted for slidably engaging and clamping said other end of said second stanchion to a further leg of the tripod.

2. The gun support as set forth in claim 1 including a first bolt for securing said first stanchion with said first clamp.

3. The gun support as set forth in claim 1 including a second bolt for securing said second stanchion with said second clamp.

4. The gun support as set forth in claim 3 including a first bolt for securing said first stanchion with said first clamp.

5. The gun support as set forth in claim 1 wherein said first clamp is selectively positionable along the first leg of the tripod.

6. The gun support as set forth in claim 1 wherein said second clamp is selectively positionable along the second leg of the tripod.

7. The gun support as set forth in claim 6 wherein said first clamp is selectively positionable along the first leg of the tripod.

8. A method for mounting a gun on a U-shaped receiver extending from a plate at the top of a tripod and within a centrally located recessed solid surface of a one-piece bracket pivotally supporting first and second stanchions, said method comprising the steps of:

(a) providing a clamp on each of two legs of the tripod;

(b) pivotally attaching the first and second stanchions to the bracket;

(c) attaching the first stanchion pivotally extending from the bracket to the clamp slidable on one of the legs;

(d) further attaching the second stanchion pivotally extending from the bracket to the clamp slidable on the other one of the legs; and (e) rotating the bracket and stanchions away from the tripod upon lateral extension of the tripod legs.

9. The method as set forth in claim 8 including the step of limiting the degree of rotation during exercise of said step of rotating.

10. The method as set forth in claim 8 including the step of slidably positioning each of the first and second clamps at corresponding locations along the respective legs of the tripod.

11. The method as set forth in claim 10 wherein said step of attaching and further attaching are carried out by nuts and bolts.

12. A gun support for a rifle, said gun support comprising:

(a) a tripod supporting a U-shaped receiver for the rifle;

(b) a one-piece solid bracket including a centrally located recessed surface for supporting the rifle;

(c) a first stanchion having one end pivotally secured to said bracket;

(d) a second stanchion having one end pivotally secured to said bracket;

(e) a first clamp slidably disposed along a first leg of said tripod for pivotally engaging another end of said first stanchion; and (f) a second clamp slidably disposed along a second leg of said tripod for pivotally engaging another end of said second stanchion.

13. The gun support as set forth in claim 12 including a first bolt for engaging said first clamp and said other end of said first stanchion and a first nut for engaging said first bolt to pivotally secure said first stanchion with said first leg of said tripod and a second bolt for engaging said second clamp and said other end of said second stanchion and a second nut for engaging said second bolt to pivotally secure said second stanchion with said second leg of said tripod.

14. The gun support as set forth in claim 12 wherein said bracket includes nubbins disposed on either side of a depressed surface for supporting the rifle.

15. The gun support as set forth in claim 12 wherein each of said first and second clamps are slidably secured to the respective foot of the respective leg of said tripod.

16. The gun support as set forth in claim 12 wherein each of said first and second stanchions is tubular.

17. The gun support as set forth in claim 16 wherein each of said other end of said first stanchion and said other end of said second stanchion is flattened for engagement with the respective one of said first and second clamps.

* * * * *